US005822867A

United States Patent [19]

Sakai

[11] Patent Number: 5,822,867

[45] Date of Patent: Oct. 20, 1998

[54] KNIFE

[75] Inventor: Kimiyuki Sakai, Seki, Japan

[73] Assignee: Gerber Sakai Co., Ltd, Gifu-Ken, Japan

[21] Appl. No.: 800,646

[22] Filed: Feb. 4, 1997

[51] Int. Cl.[6] ..... B26B 1/10

[52] U.S. Cl. ..... 30/298.4; 30/155

[58] Field of Search ..... 30/155, 164, 298.4; 224/232, 197, 666

[56] References Cited

U.S. PATENT DOCUMENTS

| | | | |
|---|---|---|---|
| 1,977,618 | 10/1934 | Boos | 30/298.4 |
| 2,839,831 | 6/1958 | Baer | 30/298.4 |
| 5,349,753 | 9/1994 | Gaffney | 30/155 |
| 5,450,670 | 9/1995 | Sakai | 30/298.4 |
| 5,495,673 | 3/1996 | Gardiner et al. | 30/155 |

*Primary Examiner*—Hwei-Siu Payer
*Attorney, Agent, or Firm*—Quarles & Brady

[57] ABSTRACT

An improved holder and pocketknife combination is disclosed. The knife has a blade and a handle. The handle has an end detachably coupled to a swivel that is rotatably connected to a snap hook. The handle has a coupling part for mating with a cooperating part of the holder. The combination also has a quick release mechanism for separating the knife from the holder. The hook is directly attached to the swivel.

21 Claims, 11 Drawing Sheets

KNIFE

BACKGROUND OF THE INVENTION

1. FIELD OF THE INVENTION

The present invention relates generally to a knife including a blade that may be folded into a handle. More specifically, the present invention relates to a pocketknife which may be easily carried and which may be disconnected from its holder.

2. DESCRIPTION OF THE RELATED ART

Pocketknives that are used for outdoor activities may be hooked to a belt loop. U.S. Pat. No. 5,450,670 describes a typical pocketknife. As shown in FIG. 16, herein this patent describes a knife 51 having a channel-like bracket 54 provided at the proximal end of a handle 52. A support 56 is attached to the bracket 54 such that it is rotatable in the directions indicated by arrow A. A hook 57 is attached to the support 56 such that it is rotatable in the directions indicated by arrow B. An opening defined in the hook 57 is closed by a flexible stopper 60. Pressing the stopper 60 with a finger opens the hook 57. As shown in FIG. 17, the hook 57 may be hooked to a belt loop 59. In this state, the knife 51 swings as its user moves.

To unhook the knife 51, the user presses the stopper 60 with a finger and then removes the hook 57 from the loop 59. This procedure may be difficult if the user is not used to unhooking the knife 51. Furthermore, quick removal of the knife 51 is difficult.

FIG. 18 shows another prior art pocketknife. A knife 61 includes a slot 63 formed at the proximal end of a handle 62 for receiving a suspender 64. A hexagonal hole 68 is provided to communicate the outer surface of the handle 62 with the inside of the slot 63. The suspender 64 includes a hook 65 and a stopper 65*a*, which opens and closes the hook 65. The suspender 64 is also provided with an attaching plate 66 which is inserted into the slot 63. A strap 67 and a ring 67*a* connect the hook 65 to the attaching plate 66. The strap 67 is made of fabric or leather. The attaching plate 66 includes a U-shaped groove 66*a*, which defines a flexible tongue 66*b*. The tongue 66*b* is provided with a hexagonal projection 66*c*.

As shown in FIG. 19, the plate 66 is inserted into the slot 63 to fit the projection 66*c* into the hole 68. This connects the suspender 64 to the knife 61. The hook 65 is then hooked to a belt loop. In this state, the projection 66*c* partially projects from the hole 68. When the projection 66*c* is pressed down by the user's finger, the projection 66*c* moves into the hole 68 due to flexibility of the tongue 66*b*. Therefore, the knife 61 may be readily detached from the hook 65 by pulling the handle 62 to remove the plate 66 out of the slot 63.

During ordinary walking, this knife 61 widely swings back and forth, which is bothersome. Also, during outdoor activities, the user may run or jump. During such movements, the knife 61 swings back and forth dramatically, and the knife 61 gets jerked by the holder due to the long flexible strap 67. This swinging is likely to overload the plate 66 or other portions of the suspender 64. For example, the periphery of the hole 68 may be damaged by stress produced by the overload.

SUMMARY OF THE INVENTION

It is an objective of the present invention to provide a pocketknife which may readily be unhooked from a belt loop and which has improved durability.

In order to achieve the above objective, a knife and holder combination according to the present invention includes a knife, a handle, a blade, a holder, a snap hook, a coupler, a pivot joint and a locking mechanism. The handle is provided on the knife which has a proximal end and a distal end. The blade is pivotally connected to the distal end of the handle. The holder is releasably coupled to the knife, and has a proximal end and a distal end. The snap hook is provided on the proximal end of the holder, and is directly joined to a swivel member which has at least one pivot axis. The coupler includes a pair of mating parts for releasably coupling the knife to the holder. A first of the mating parts is formed on the proximal end of the knife handle and a second mating part is joined to the swivel member. The pivot joint is formed on the second mating part for receiving the swivel member such that the second mating part is pivotally connected to the swivel member. The pivot joint is directly adjacent to the second mating part. The locking mechanism locks one of the mating parts to the other, and has a quick release member for quickly releasing the locking mechanism.

Other aspects and advantages of the invention will become apparent from the following detailed description, taken in conjunction with the accompanying drawings illustrating by way of examples the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 3 is a front view showing the knife of FIG. 1 separated from an engaging plate with the blade folded in;

FIG. 5 is a front view partially in section showing the knife with the blade folded in;

DETAILED DESCRIPTION OF THE PREFERRED EMBODIMENTS

A preferred embodiment according to the present invention will now be described with reference to FIGS. 1 through 11.

Figure 1:
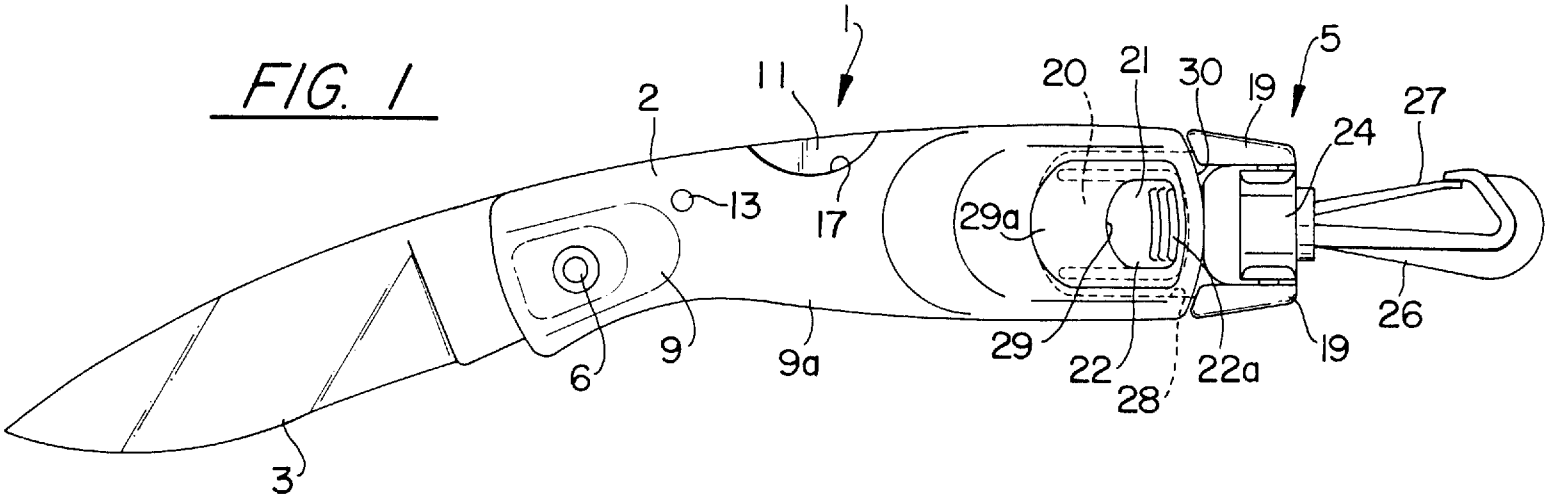
FIG. 1 is a front view showing a first embodiment of the present invention with a blade folded out.
Figure 2:
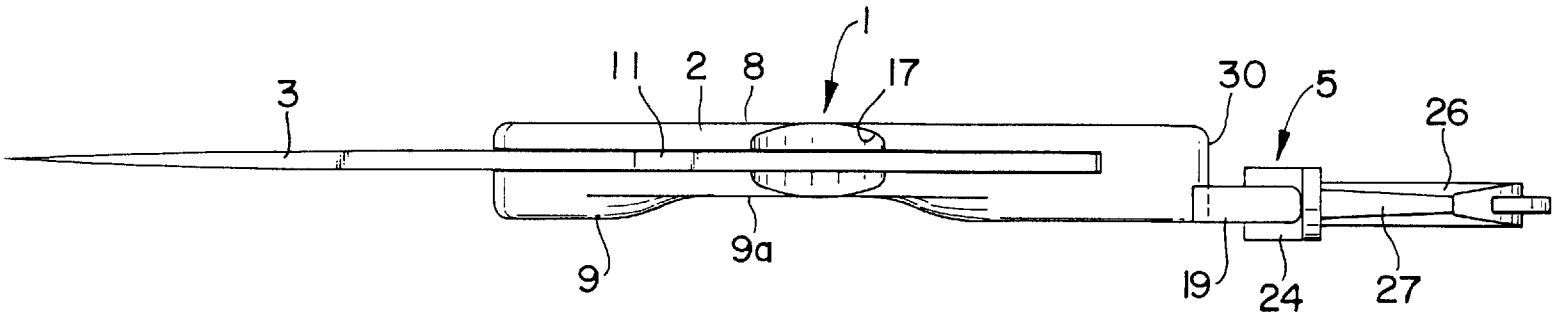
FIG. 2 is a plan view of the knife of FIG. 1.
Figure 3:
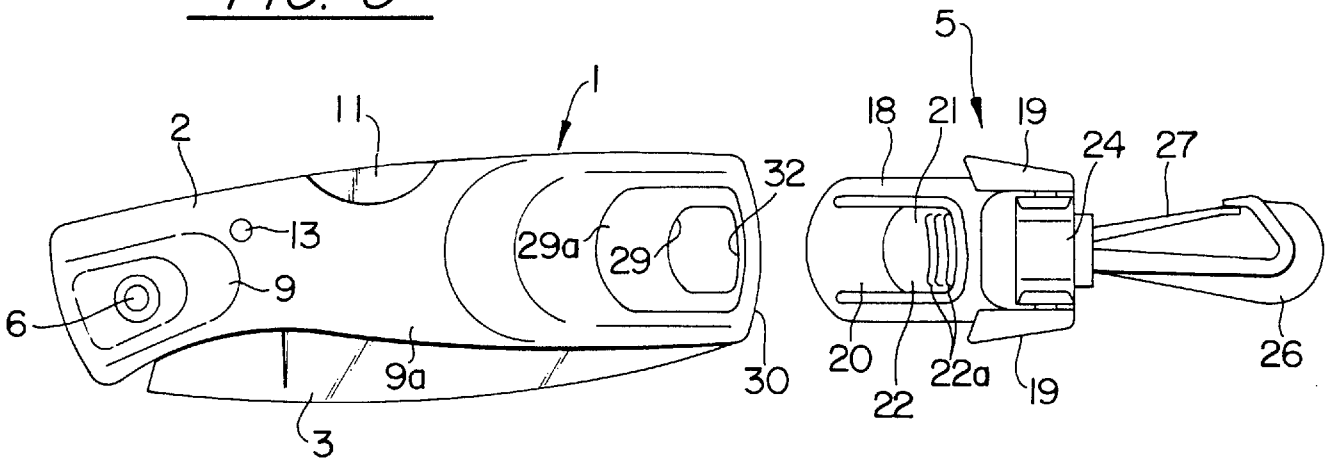

As shown in FIGS. 1 to 3, a knife 1 includes a handle 2, which is made of synthetic resin, and a metal blade 3. The blade 3 is pivotable about a pin 6 between the extended position shown in FIGS. 1 and 2 and the folded position shown in FIG. 3.

As shown in FIG. 2, the handle 2 has a first side 8 and a second side 9. When the handle 2 is gripped with the right hand, the palm contacts the first side 8 and fingers contact the second side 9. The second side 9 includes a recessed portion 9*a* to allow easy gripping.

Figure 4:
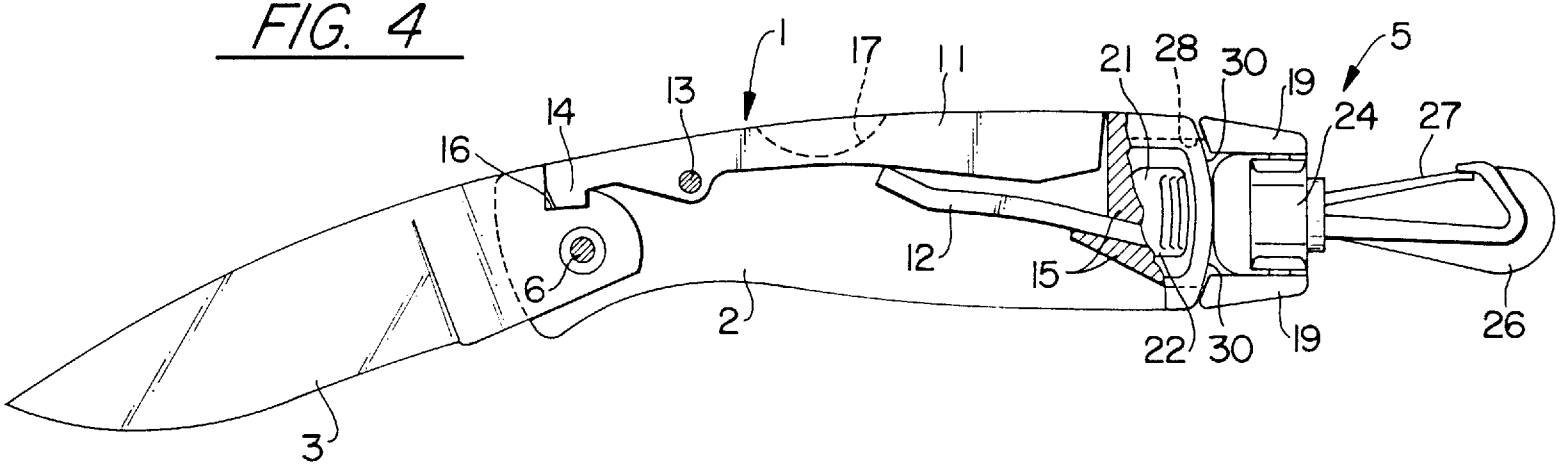
FIG. 4 is a front view partially in section showing the knife with the blade folded out.
Figure 5:
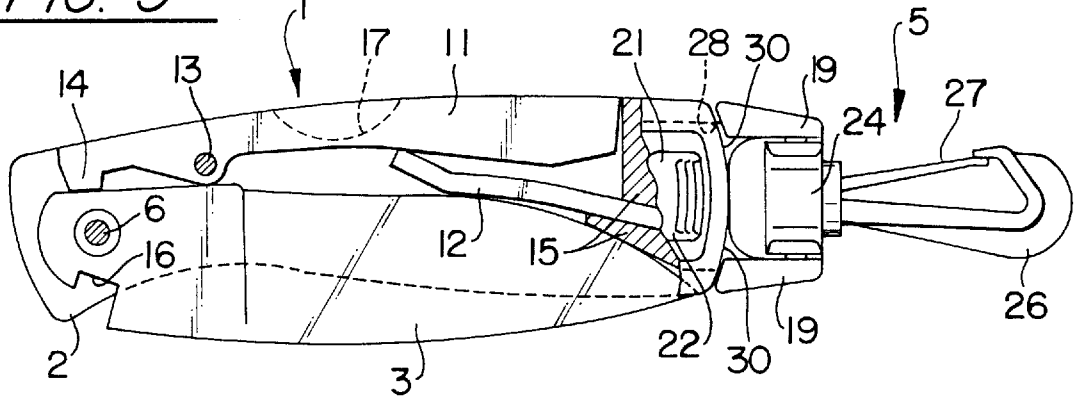

As shown in FIGS. 4 and 5, an elongated back bolster 11 and a leaf spring 12 located inside the handle 2 define a supporting mechanism for the blade 3. The bolster 11 is rotatable around a pin 13 at the distal end portion of the handle 2. A projection 14 is formed at the distal end of the bolster 11. The projection 14 engages with a recess 16 of the blade 3. The leaf spring 12 is cantilevered by a solid inner wall 15 of the handle 2. The distal end of the spring 12 engages with the bolster 11. Therefore, the spring 12 biases the bolster 11 counterclockwise (as viewed in FIG. 4) with respect to the pin 13. As shown in FIG. 4, this prevents the blade 3 from pivoting clockwise with respect to the pin 6 when the blade 3 extends from the handle 2. On the other hand, as shown in FIG. 5, the projection 14 contacts the proximal end of the blade 3. The projection 14 biases the blade 3 to hold the blade 3 in the folded position.

As shown in FIGS. 4 and 5, a notch 17 is defined in the upper middle portion of the handle 2 to expose a portion of the bolster 11. Pressing the bolster 11 causes the projection 14 to disengage from the recess 16. This allows the blade 3 to be folded into the handle 2. The above supporting mechanism of the knife is described in U.S. Pat. No. 5,450,670, which is incorporated herein by reference.

Figure 6:
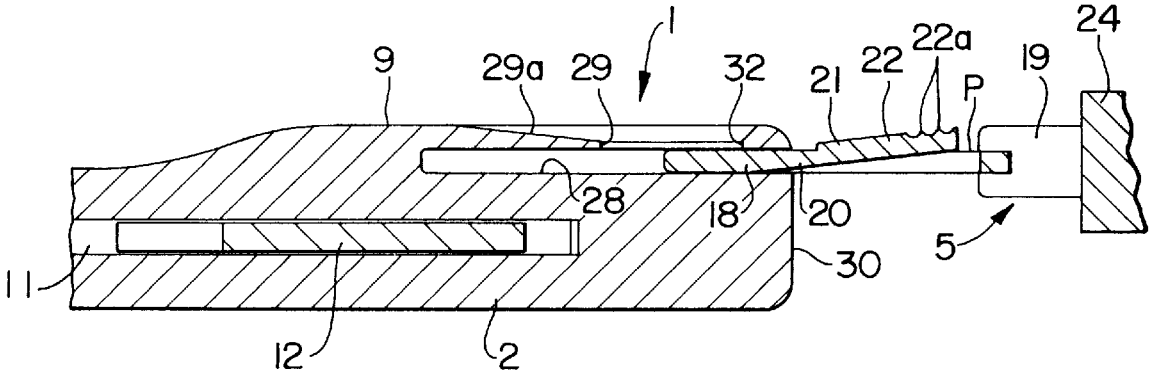
FIG. 6 is a partial sectional view showing engagement between a handle and an engaging plate of the knife.
Figure 7:
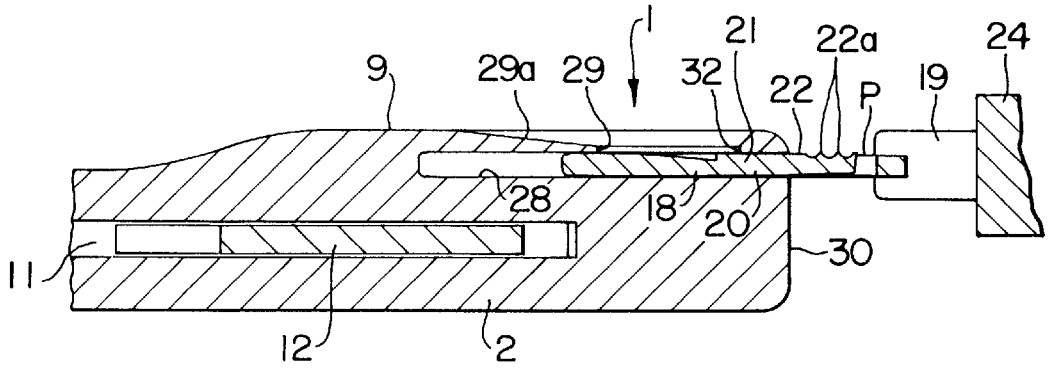
FIG. 7 is a partial sectional view showing engagement between the handle and the engaging plate of the knife.
Figure 8:
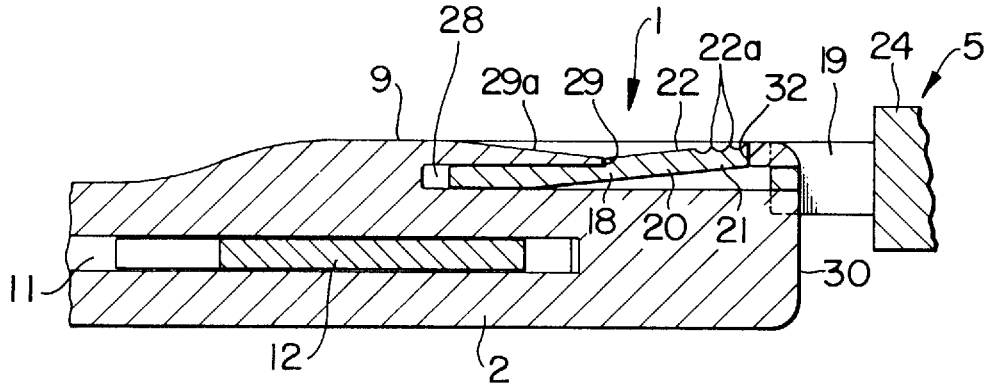
FIG. 8 is a partial sectional view showing engagement between the handle and the engaging plate of the knife.

As shown in FIGS. 1 and 2, a holder 5 is attached to the proximal end of the handle 2 with a pair of mating parts that form a coupler. FIG. 3 shows the holder 5 disconnected from the handle 2. The holder 5 includes an engaging plate 18, which forms one of the mating parts of the coupler, and a pair of arms 19. A U-shaped groove is provided in the center of the plate 18 to define a tongue 20. As shown in FIGS. 6 to 8, the tongue 20 includes a leaf spring 21 bent upward with respect to the plane P of the plate 18. Pressing the top surface 22 of the spring 21 causes the tongue 20 to be bent downward with respect to flex toward the plane P of the plate 18. A plurality of ridges 22*a* extend in the direction perpendicular to the longitudinal axis of the plate 18 to form an anti-slip surface. When the surface 22 is pressed down with a finger, the edges 22*a* engage the finger and enhance the friction between the finger and the surface 22.

Figure 10:
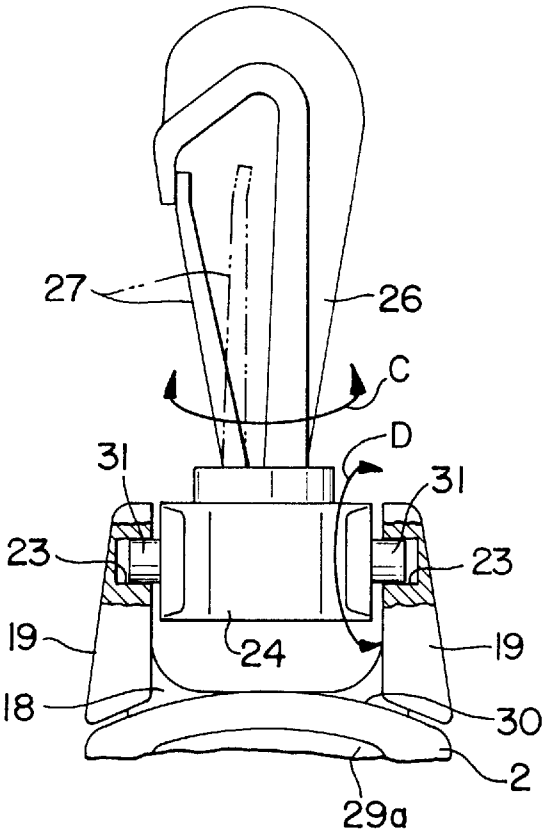
FIG. 10 is a partial enlarged front view showing a hook of the knife.

As shown in FIG. 10, a swivel connector 24 is supported between a pair of spaced arms 19. The arms 19 are formed integrally with the plate 18 and made of synthetic resin. Each of the arms 19 is provided with a certain flexibility. A pair of concentric bearing holes 23 are separately provided in each of the arms 19. The bearing holes 23 form a pivot joint.

The swivel connector 24 is provided with a pair of aligned support shafts 31. The shafts 31 are received in each of the holes 23 such that they are rotatable about their axis in the directions indicated by arrow D. A hook 26 and a flexible stopper 27 are mounted to the swivel connector 24. The opening of the hook 26 is closed by the distal end of the stopper 27. Pressing the stopper 27 disengages the stopper 27 from the hook 26 and opens the hook 26. Both the hook 26 and the stopper 27 are rotatable in the directions indicated by arrow C with respect to the swivel connector 24.

As shown in FIGS. 6 to 8, a receptacle 28 is defined in the proximal end of the handle 2 for inserting the plate 18. Thus, the receptacle 28 forms a mating part of the coupler. The receptacle 28 is open toward the proximal end 30 of the handle 2. A through hole 29 communicates the inside of the receptacle 28 with the outside of the knife. A tapered or chamfered surface 29*a* is defined about the hole 29 such that it becomes wider as it approaches the second side 9. The surface 29*a* extends toward surface of the second side 9. As shown in FIG. 8, the opening of the hole 29 adjacent to the receptacle 28 has a form that cooperates with the spring 21. A wall 32 is formed along one side of the opening 29 for engaging an end of the spring 21. Accordingly, as shown in FIG. 8, the plate 18 is supported in the receptacle 28 when the holder 5 is connected to the handle 2. The spring 21 is fitted in the hole 29 with its distal end engaging the wall 32.

Figure 11:
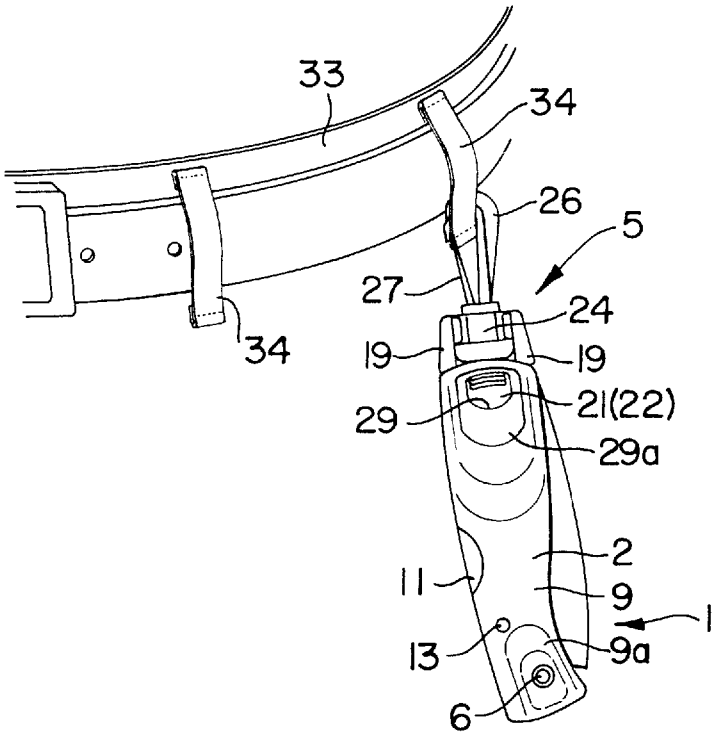
FIG. 11 is a view showing the knife hung from a belt loop.

As shown in FIG. 11, the swivel connector 24 is hooked to a belt loop 34 of pants 33 with the hook 26. The knife 1 is thus hung with the blade folded in the handle 2. The knife is used by removing the handle 2 from the holder 5. In other words, when the knife 1 is hooked to the loop 34, the plate 18 is supported in the receptacle 28 as shown in FIG. 8. In this state, the tongue 20 engages with the wall 32 and is partially exposed through the hole 29.

Figure 9:
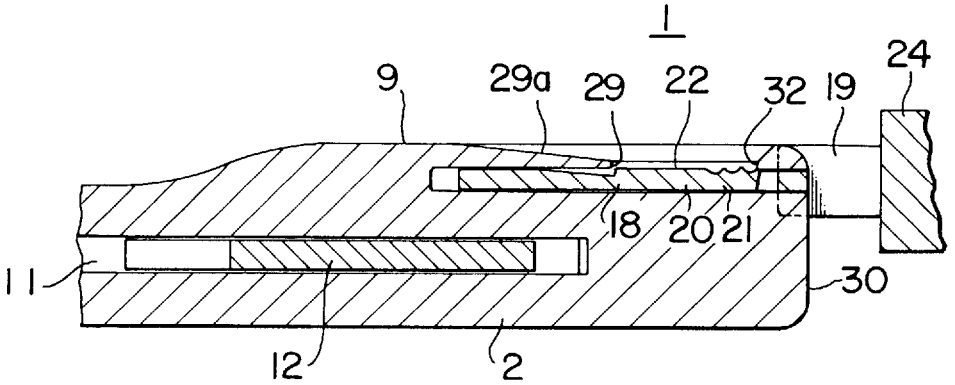
FIG. 9 is a partial sectional view showing engagement between the handle and the engaging plate of the knife.

As shown in FIG. 9, pressing the surface 22 disengages the spring 21 from the wall 32 and removes the spring 21 from the hole 29. When the handle 2 is pulled away from the holder 5 with the tongue 20 continuously pressed, the spring 21 is permitted to exit the receptacle 28 as shown in FIG. 7. Further pulling of the handle 2 causes disengagement between the tongue 20 and the receptacle 28 as shown in FIG. 6. As a result, the spring 21 flexes outward away from the plane P to restore itself to its normal position. When the handle 2 is uncoupled, the holder 5 remains engaged with the loop 34. The knife 1 is thus removed from the holder 5 without unhooking the hook 26. Thus, the spring 21 and the wall 32 form a locking mechanism, and the spring 21 forms a quick release mechanism.

To re-connect the knife 1 to the holder 5, the plate 18 is again inserted into the receptacle 28 as shown in FIG. 6. Subsequently, pushing the handle 2 toward the holder 5 flexes the spring 21 forwards the plane P in the receptacle 28 as shown in FIG. 7. When the handle 2 is further pushed toward the holder 5, the spring 21 is fitted in the hole 29 as shown in FIG. 8. The distal end of the spring 21 thus engages with the wall 32. The knife 1 is thus firmly coupled to the holder 5.

As described above, the knife 1 may simply be removed from the holder 5 by pressing the surface 22. As a result, the knife 1 is quickly removed from the holder 5. In addition, the hook 26 is rotatable with respect to the swivel connector 24 while the swivel connector 24 is rotatable with respect to the arms 19. Therefore, as shown in FIG. 10, the axis of rotation of the hook 26 is perpendicular to the rotational axis of the swivel connector 24. The arrangement and construction of the knife and holder combination result in a total length that is as short as possible thus reducing the amount of swinging to and fro while the knife is worn on a belt loop.

Furthermore, the recess portion 9*a* allows the handle 2 to be gripped firmly. In addition, the proximal portion of the handle 2 having the receptacle 28 is provided with increased thickness. This enhances the strength of the proximal portion of the handle 2.

Moreover, the distance from the distal end of the holder 5 to the surface 30 is constant. Therefore, the spring 21 and the wall 32 are protected from overload due to the jerking of the knife 1.

In addition, the arms 19 are made of elastic synthetic resin. This allows the arms 19 to be spread using a jig or tool. In this state, the holder 5 may be disengaged from the arms 19. Therefore, the hook 26 and swivel connector 24 can be easily replaced. The swivel connector 24 may be mounted to the arms simply by inserting the shafts 31 into the holes 23. The ability to replace the swivel connector 24 allows the knife 1 to be used for a longer period of time than a conventional pocketknife.

Although only one embodiment of the present invention has been disclosed so far, it should be apparent to those skilled in the art that the present invention may be embodied in many other specific forms without departing from the spirit or scope of the invention. Particularly, it should be understood that the invention may be further embodied in the following manners.

(1) Another embodiment of the present invention is shown in FIGS. 12 to 15. A holder 35 includes an engaging plate 36 and a pair of arms 37. The plate 36 includes first and second disc-like holding plates 38, 39 facing each other. A slot 40 is defined between the plates 38, 39. The first plate 38 is provided with a circular through hole 41. A tapered surface 41*a* extends from the hole 41 toward the outer surface of the plate 38. At the center portion of the second plate 39, a tongue 42 is defined by a U-shaped groove. The tongue 42 includes a stepped portion 43 at its distal end. The stepped portion 43 extends toward the slot 40. The arms 37 are constructed in the same manner as the arms 19 of first embodiment.

Figure 12:
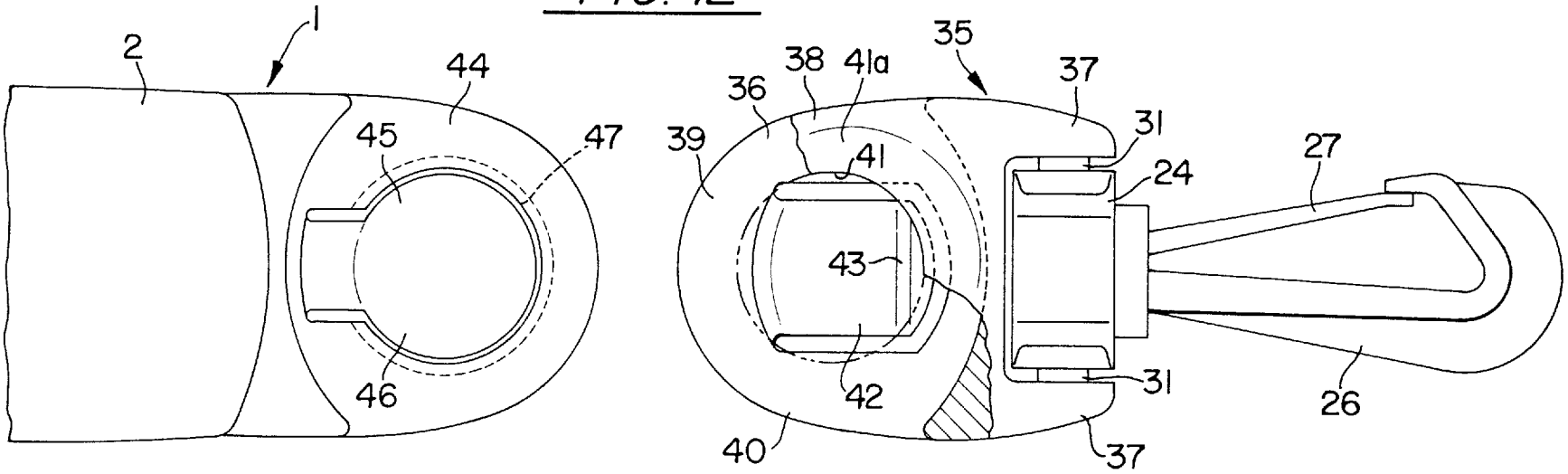
FIG. 12 is a partial enlarged front view showing a second embodiment of the knife.
Figure 13:
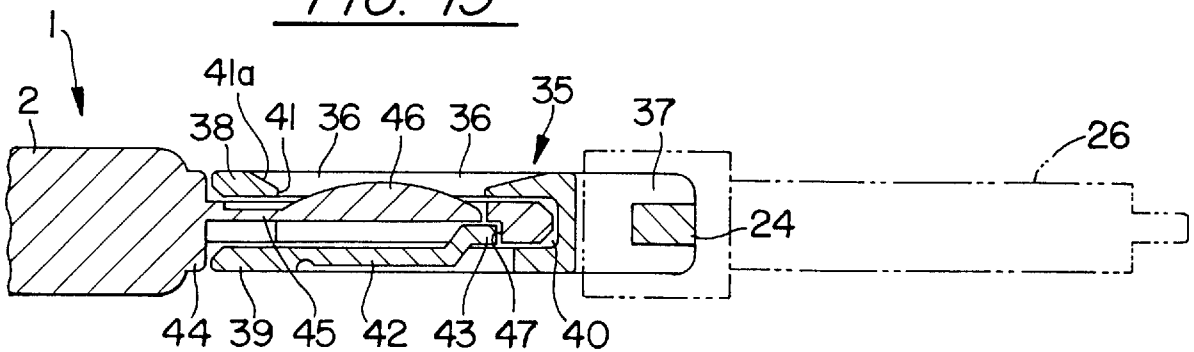
FIG. 13 is a partial enlarged sectional view showing the knife of FIG. 12.

A coupler end 44 of the handle 2 is supported between the plates 38, 39. At the center of the coupled end 44, a flexible release member 45 is defined by a U-shaped groove. The release member 45 includes a surface 46 having a form that corresponds with the hole 41. As shown in FIGS. 12 and 13, an annular recess 47 is defined around the periphery of the release member 45 in one surface of the coupler end 44 (the lower portion as shown in FIG. 13).

Figure 14:
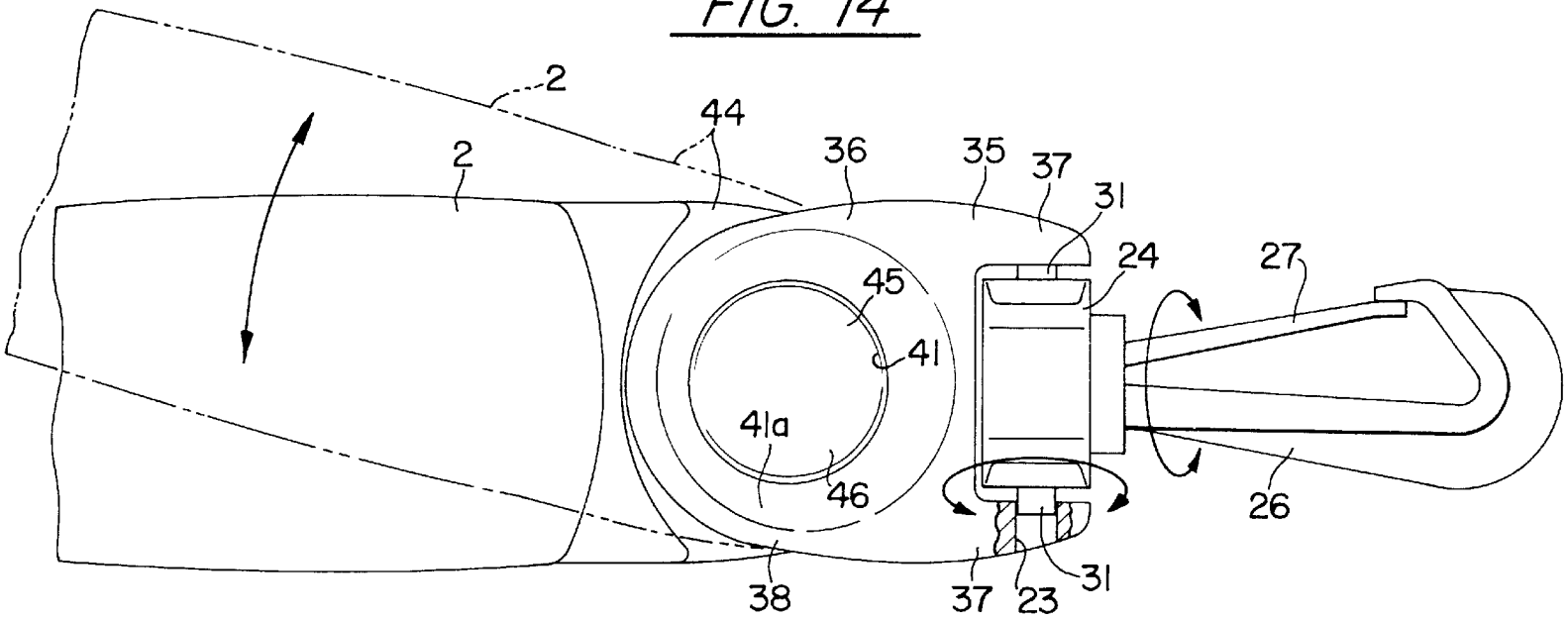
FIG. 14 is a partial enlarged front view of the knife of FIG. 12.

When the handle 2 is connected to the holder 35 as shown in FIG. 14, the release member 45 is received in the slot 40 defined between the plates 38, 39. In this state, the stepped portion 43 of the tongue 42 is fitted in the recess 47 of the coupler end 44 as shown in FIG. 13. The stepped portion 43 is supported pivotally in the recess 47 along the outer periphery of the release member 45. Concurrently, the stepped portion 43 engages with the side wall of the recess 47 to secure the coupler end 44 to the holder 35. FIG. 14 shows the handle 2 pivoting with respect to the holder 35.

Figure 15:
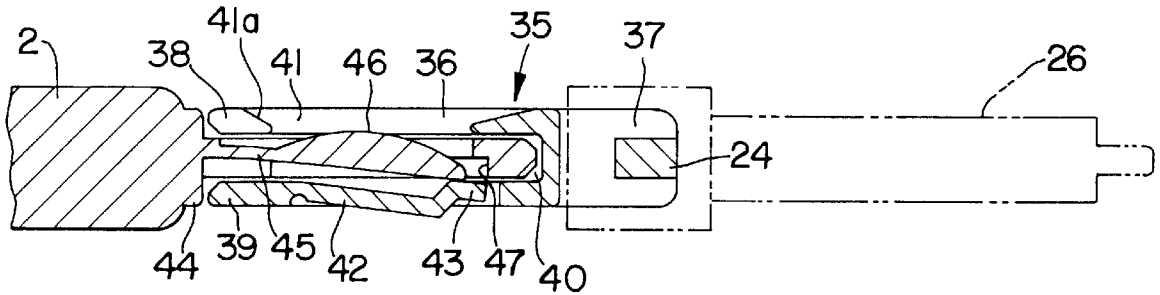
FIG. 15 is a partial enlarged sectional view showing the knife of FIG. 12.
Figure 16:
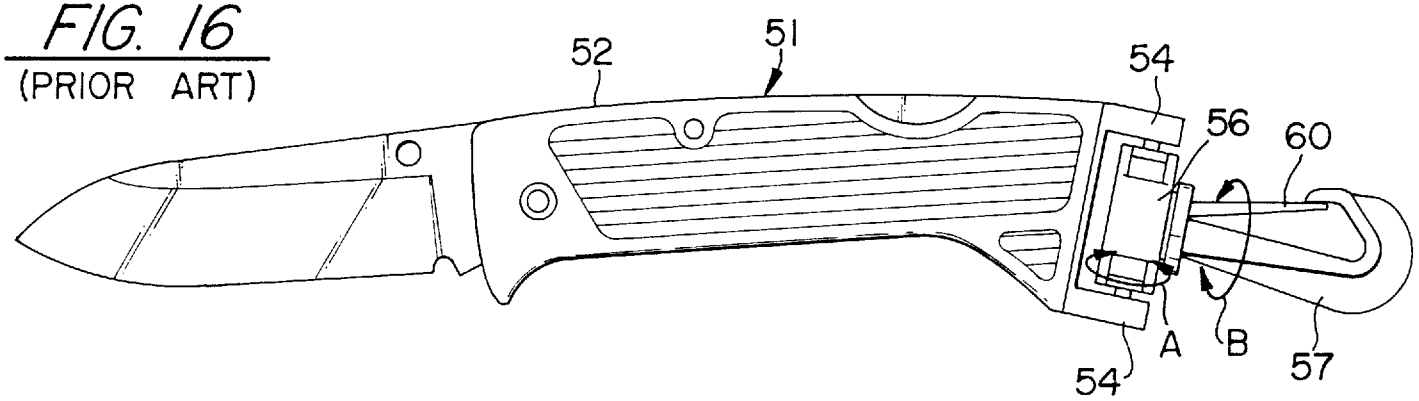
FIG. 16 (PRIOR ART)
FIG. 16 is a front view showing a conventional knife.
Figure 17:
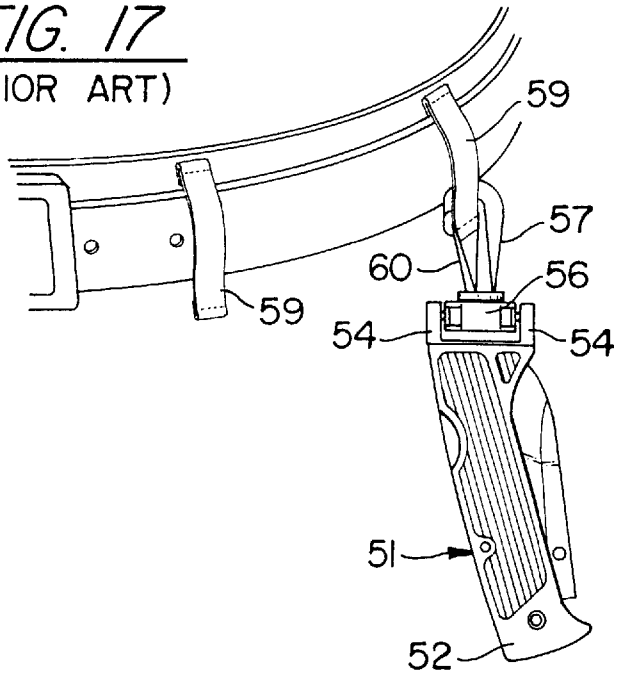
FIG. 17 (PRIOR ART)
FIG. 17 is a view showing the conventional knife hung from a belt loop.
Figure 18:
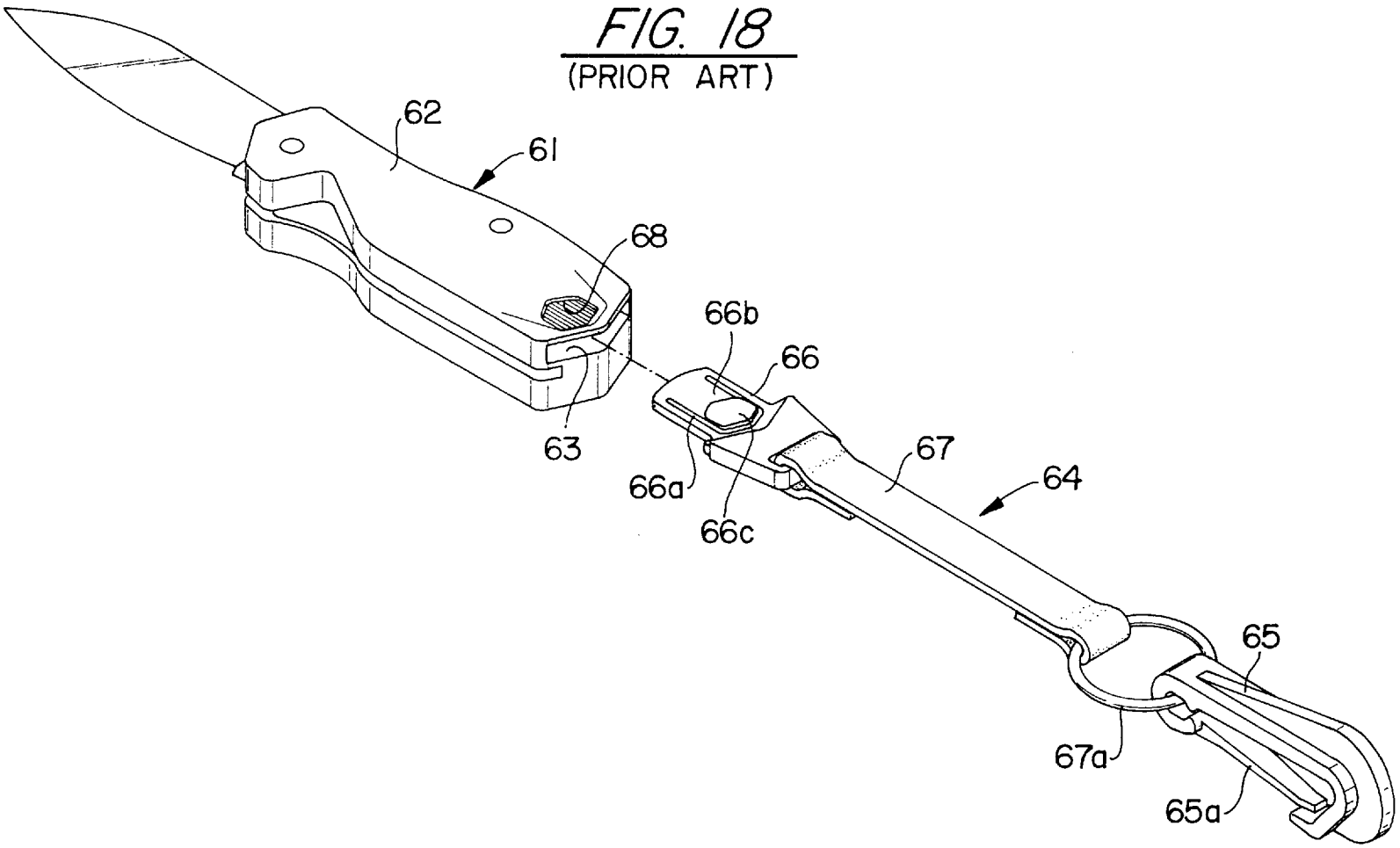
FIG. 18 (PRIOR ART)
FIG. 18 is a perspective view showing another conventional knife.
Figure 19:
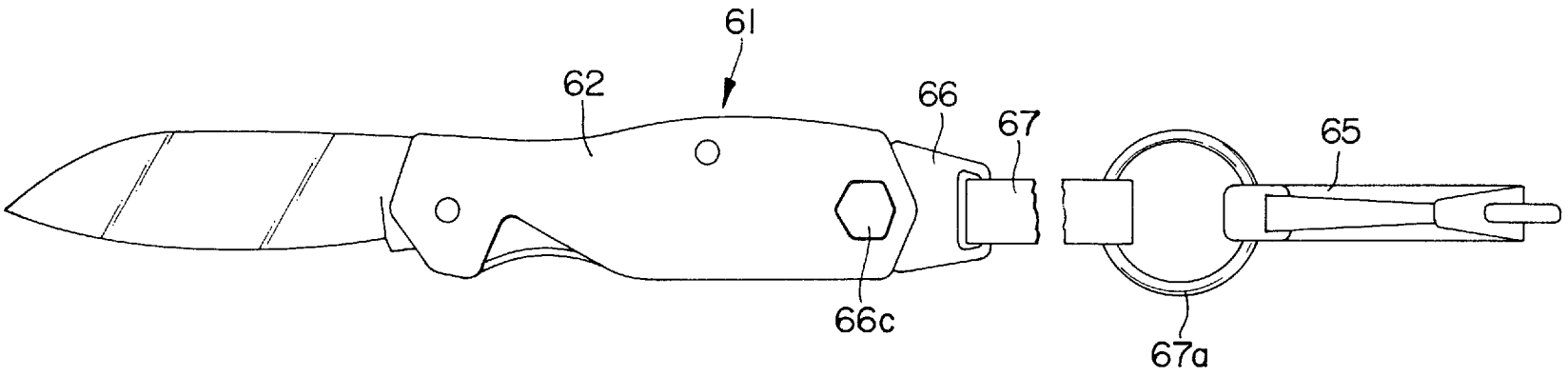
FIG. 19 (PRIOR ART)
FIG. 19 is a front view showing the conventional knife of FIG. 18.

When the handle 2 is connected to the holder 35 as described above, the knife 1 may be hooked to the belt loop 34. To remove the knife 1, the surface 46 is pressed down as shown in FIG. 15. Then the release member 45 is flexed toward the first tongue 42 and causes the stepped portion 43 to disengage from the recess 47. When the handle 2 is pulled away from the holder 35, the first tongue 42 disengages from the release member 45. When the knife 1 is separated from the holder 35, the holder 35 remains hooked to the belt loop 34. The knife 1 is thus readily disconnected from the holder 35.

For connecting the knife 1 to the holder 35, the coupler end 44 is inserted into the slot 40 defined in the holder 35. In this state, pushing the handle 2 toward the holder 35 causes the stepped portion 43 to settle in the recess 47 as shown in FIG. 13. The knife 1 is thus connected the holder 35.

Therefore, the present examples and embodiments are to be considered as illustrative and not restrictive and the invention is not to be limited to the details given herein, but may be modified within the scope of the appended claims.

What is claimed is:

1. A knife and holder combination comprising:

a knife;

a handle on the knife having a proximal end and a distal end;

a blade pivotally connected to the distal end of the handle;

a holder releasably coupled to the knife, the holder having a proximal end and a distal end;

a snap hook on the proximal end of the holder, wherein the snap hook is directly joined to a swivel member, the swivel member having at least one pivot axis;

a coupler including a pair of mating parts for releasably coupling the knife to the holder, a first of the mating parts being formed on the proximal end of the knife handle and a second mating part being joined to the swivel member;

a pivot joint formed on the second mating part for receiving the swivel member such that the second mating part is pivotally connected to the swivel member, wherein the pivot joint is directly adjacent to the second mating part;

a locking mechanism for locking one of the mating parts to the other, the locking mechanism having a quick release member for quickly releasing the locking mechanism.

2. The knife and holder of claim 1, wherein the first mating part is formed by a slot in the proximal end of the handle and the second mating part is a plate connected to the swivel member by the pivot joint, wherein the plate is constructed to fit inside and lock with the slot.

3. The knife and holder of claim 2, wherein the slot has a hole communicating the interior of the slot with the surface of the handle, and wherein the plate includes a flexible tongue that is constructed to settle in the hole when the plate is fully fit inside the slot, and wherein the flexible tongue serves as the quick release member and is arranged to be manipulated to release the coupler.

4. The knife and holder of claim 3, wherein the flexible tongue has anti-slip ridges formed thereon.

5. The knife and holder of claim 2, wherein the slot has a hole communicating the interior of the slot with the surface of the handle, and wherein the handle has a chamfered surface about the hole.

6. The knife and holder of claim 1, wherein one of the mating parts includes a pair of spaced arms, and wherein the spaced arms include the pivot joint such that the swivel member is pivotally held between the spaced arms.

7. The knife and holder of claim 6, wherein the spaced arms are elastically flexible to permit removal and replacement of the swivel member.

8. The knife and holder of claim 1, wherein the coupler is pivotable such that each of the mating parts may pivot with respect to the other.

9. The knife and holder of claim 8, wherein one of the mating parts includes a flexible tongue having a distal end, the distal end having the shape of an arc, and wherein the other mating part includes an arc shaped wall for cooperating with the end of the flexible tongue such that the tongue may slide with respect to the wall, the wall and the tongue forming the locking mechanism.

10. The knife and holder of claim 9, wherein flexing the tongue in a predetermined direction causes it to disengage from the wall to release the coupler.

11. The knife and holder of claim 10, wherein the second mating part includes the flexible tongue and the first mating part includes a flexible release member that is manually pressed to engage and flex the tongue and release the locking mechanism.

12. The knife and holder of claim 11, wherein the second mating part includes a hole through which the flexible release member is exposed when the mating parts are coupled.

13. The knife and holder of claim 1, wherein the swivel member has a second pivot axis perpendicular to said at least one pivot axis, and wherein the snap hook is rotatable about the second pivot axis with respect to the swivel member.

14. A knife and holder combination comprising:

a knife;

a handle on the knife having a proximal end and a distal end;

a blade pivotally connected to the distal end of the handle;

a holder releasably coupled to the knife, the holder having a proximal end and a distal end;

a snap hook on the proximal end of the holder, wherein the snap hook is directly joined to a swivel member, the swivel member having at least one pivot axis;

a coupler including a pair of mating parts for releasably coupling the knife to the holder, a first of the mating parts being formed on the proximal end of the knife handle and a second mating part being joined to the swivel member;

a pivot joint formed on the second mating part for receiving the swivel member such that the second mating part is pivotally connected to the swivel member, wherein the pivot joint is directly adjacent to and is rigidly connected to the second mating part;

a locking mechanism for locking one of the mating parts to the other, the locking mechanism having a quick release member for quickly releasing the locking mechanism.

15. The knife and holder of claim 14, wherein the first mating part is formed by a slot in the proximal end of the handle and the second mating part is a plate connected to the swivel member by the pivot joint, wherein the plate is constructed to fit inside and lock with the slot.

16. The knife and holder of claim 15, wherein the slot has a hole communicating the interior of the slot with the surface of the handle, and wherein the plate includes a flexible tongue that is constructed to settle in the hole when the plate is fully fit inside the slot, and wherein the flexible tongue serves as the quick release member and is arranged to be manipulated to release the coupler.

17. The knife and holder of claim 15, wherein the slot has a hole communicating the interior of the slot with the surface of the handle, and wherein the handle has a chamfered surface about the hole.

18. The knife and holder of claim 14, wherein one of the mating parts includes a pair of spaced arms, and wherein the spaced arms include the pivot joint such that the swivel member is pivotally held between the spaced arms.

19. The knife and holder of claim 18, wherein the spaced arms are elastically flexible to permit removal and replacement of the swivel member.

20. The knife and holder of claim 14, wherein the coupler is pivotable such that each of the mating parts may pivot with respect to the other.

21. The knife and holder of claim 20, wherein one of the mating parts includes a flexible tongue having a distal end, the distal end having the shape of an arc, and wherein the other mating part includes an arc shaped wall for cooperating with the end of the flexible tongue such that the tongue may slide with respect to the wall, the wall and the tongue forming the locking mechanism, and wherein flexing the tongue in a predetermined direction causes it to disengage from the wall to release the coupler.

* * * * *